US007215228B2

(12) United States Patent
Rhein

(10) Patent No.: US 7,215,228 B2
(45) Date of Patent: May 8, 2007

(54) CIRCUIT INTERRUPTING DEVICE WITH A TURNBUCKLE AND WELD BREAK ASSEMBLY

(75) Inventor: David A. Rhein, Columbia, MO (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/938,881

(22) Filed: Sep. 13, 2004

(65) Prior Publication Data

US 2005/0067380 A1 Mar. 31, 2005

Related U.S. Application Data

(60) Continuation-in-part of application No. 10/759,086, filed on Jan. 20, 2004, now Pat. No. 6,852,939, and a continuation-in-part of application No. 10/759,087, filed on Jan. 20, 2004, now Pat. No. 6,794,596, which is a division of application No. 10/117,338, filed on Apr. 8, 2002, now Pat. No. 6,753,493.

(60) Provisional application No. 60/294,581, filed on Jun. 1, 2001.

(51) Int. Cl.
*H01H 1/48* (2006.01)
*H01H 1/50* (2006.01)
*H01H 75/00* (2006.01)

(52) U.S. Cl. ..... 335/6; 335/15; 335/197

(58) Field of Classification Search ..... 218/120, 218/140, 154; 335/220–234, 6, 15, 185, 335/189, 192, 194, 197
See application file for complete search history.

(56) References Cited

U.S. PATENT DOCUMENTS

| | | | | |
|---|---|---|---|---|
| 2,972,032 | A | 2/1961 | Persson | |
| 3,411,038 | A | 11/1968 | Lee | |
| 3,489,573 | A | 1/1970 | Kurtz et al. | |
| 3,527,910 | A | 9/1970 | Mitchell, Jr. et al. | |
| 3,780,349 | A | 12/1973 | Nitta et al. | |
| 4,568,804 | A | 2/1986 | Luehring | |
| 5,175,403 | A | 12/1992 | Hamm et al. | |
| 5,834,725 | A | 11/1998 | Clarke et al. | |
| 6,218,921 | B1 * | 4/2001 | Eberts et al. | 335/176 |
| 2003/0193382 | A1 * | 10/2003 | Shiga et al. | 335/126 |
| 2004/0050820 | A1 | 3/2004 | McKean et al. | |
| 2004/0118815 | A1 | 6/2004 | Marchand et al. | |

FOREIGN PATENT DOCUMENTS

| | | | |
|---|---|---|---|
| EP | 0 740 322 | A | 10/1996 |
| GB | 2 292 249 | A | 2/1996 |
| WO | WO 96/36982 | A | 11/1996 |

* cited by examiner

*Primary Examiner*—Ramon M. Barrera
(74) *Attorney, Agent, or Firm*—Kevin M. Barner; Mark S. Bicks; Alfred N. Goodman

(57) ABSTRACT

A circuit interrupting device has a circuit interrupter with a stationary contact and a moveable contact. The movable contact is movable relative to the stationary contact between a closed position that allows current to pass through the circuit interrupter and an open position separating the contacts and preventing current from passing through the circuit interrupter. The movable contact is controlled by a solenoid assembly. The movable contact is connected to a plunger of the solenoid assembly by a turnbuckle and weld break assembly. The turnbuckle and weld break assembly permits adjusting the contact wipe distance and generates a hammer force to break any welds between the contacts of the vacuum interrupter.

39 Claims, 4 Drawing Sheets

CIRCUIT INTERRUPTING DEVICE WITH A TURNBUCKLE AND WELD BREAK ASSEMBLY

CROSS-REFERENCE TO RELATED APPLICATIONS

This application is a continuation-in-part of prior application Ser. No. 10/759,086, filed Jan. 20, 2004, now U.S. Pat. No. 6,852,939 and 10/759,087, filed Jan. 20, 2004; now U.S. Pat. No. 6,794,596 which are both divisionals of application Ser. No. 10/117,338, filed Apr. 8, 2002, now U.S. Pat. No. 6,753,493; which claims the benefit of U.S. Provisional Application No. 60/294,581, filed Jun. 1, 2001. The subject matter of each of these applications is incorporated herein by reference in its entirety.

FIELD OF THE INVENTION

The present invention relates to a device for interrupting an electrical circuit. More specifically, the present invention relates to a vacuum interrupter driven by a magnetic solenoid.

BACKGROUND OF THE INVENTION

Conventional circuit interrupting devices, such as circuit breakers, sectionalizers, and reclosers, provide protection for power distribution systems and the various apparatus on those power distribution systems by isolating a faulted section from the main part of the system. A fault current in the system can occur under various conditions, including lightning, an animal or tree shorting the power lines, or different power lines contacting each other.

Conventional circuit interrupting devices sense a fault and interrupt the current path. Conventional reclosers also reclose the current path and monitor continued fault conditions, thereby re-energizing the utility line upon termination of the fault. This provides maximum continuity of electrical service. If a fault is permanent, the recloser remains open after a certain pre-set number of reclosing operations.

Conventional circuit interrupters typically have opposing contacts. The opposing contacts move from an open position where the contacts are separated and no current passes between them to a closed position where the contacts abut one another, allowing current to pass between them. The contacts are usually sealed into a vacuum bottle to minimize the arcing that occurs when the contacts are opened and closed. Arcing is undesirable because it causes erosion of the contacts. Arcing can also weld the opposing contacts together, effectively preventing operation of the circuit interrupter.

Examples of conventional circuit interrupting devices include U.S. Pat. No. 6,242,708 to Marchand et al.; U.S. Pat. No. 5,663,712 to Kamp; U.S. Pat. No. 5,175,403 to Hamm et al.; U.S. Pat. No. 5,103,364 to Kamp; U.S. Pat. No. 5,099,382 to Eppinger; U.S. Pat. No. 4,568,804 to Luehring and U.S. Pat. No. 4,323,871 to Kamp et al. The subject matter of each of these patents is incorporated herein by reference in its entirety.

SUMMARY OF THE INVENTION

An object of the present invention is to provide a circuit interrupting device that is actuated by a solenoid.

Another object of the present invention is to provide a circuit interrupting device that can break welds between contacts in the circuit interrupting device.

A further object of the present invention is to provide a circuit interrupting device that compensates for erosion of the contacts that occurs during operation.

These objects are basically attained by a circuit interrupting device that has a circuit interrupter with a stationary contact and a moveable contact. The movable contact is actuated by a solenoid assembly and is movable between a closed position and an open position. In the closed position, the contacts abut one another and allow current to pass through the circuit interrupter. In the open position, the contacts are separated by a gap, preventing current from passing through the circuit interrupter. The movable contact is connected to a plunger of the solenoid assembly by a turnbuckle and weld break assembly. The turnbuckle and weld break assembly functions as a turnbuckle and thereby provides the ability to adjust the wipe distance of the contacts. The turnbuckle and weld break assembly also generates a hammer force to break any welds between the contacts.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
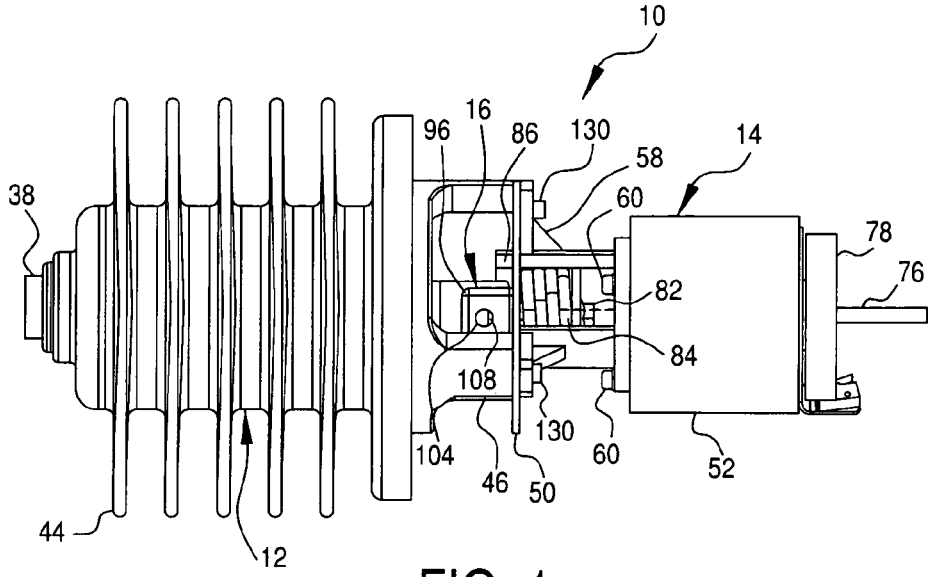
FIG. 1 is a side elevational view of a circuit interrupting device in accordance with an embodiment of the present invention.
Figure 2:
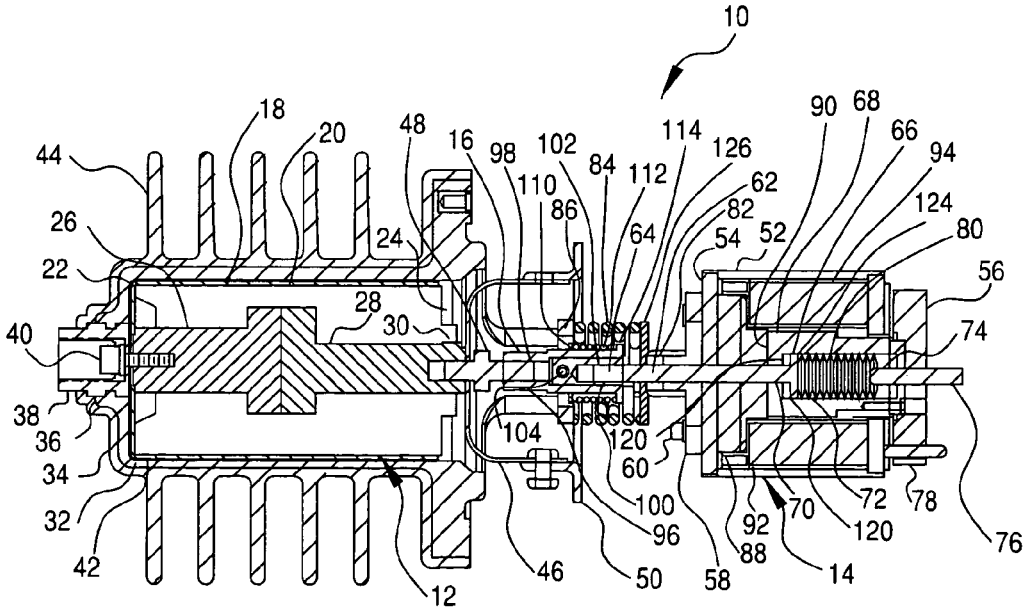
FIG. 2 is a side elevational view in section of the circuit interrupting device illustrated in FIG. 1.

Referring to FIGS. 1–7, a circuit interrupting device 10 in accordance with an embodiment of the invention has a vacuum interrupter 12 connected to a solenoid assembly 14 by a turnbuckle and weld break assembly 16.

The vacuum interrupter 12 is conventional and therefore is only described in sufficient detail to allow one of ordinary skill in the art to make and use the present invention. The vacuum interrupter 12 provides voltage switching and includes a vacuum bottle 18 having a ceramic outer shell 20 with a first end 22 and a second opposing end 24. A stationary or primary contact 26 is fixed at the first end 22 and a movable contact 28 is slidably supported in an opening 30 at the second end 24. A seal (not shown) can be provided to ensure a vacuum is maintained in the vacuum bottle 18.

The contacts 26, 28 are preferably made of a conductive material, such as copper. The movable contact 28 is connected to and operated by the solenoid assembly 14. When the stationary contact 26 and movable contact 28 are in contact, the vacuum interrupter is in the closed position and the circuit interrupting device 10 is operating and conducting electrical power under normal conditions. During a fault, the movable contact 28 is separated from the stationary contact 26, typically by about a fraction of an inch, e.g. about 9 mm, to an open position, thereby interrupting the current path and isolating a fault current.

The vacuum interrupter 12 should meet certain minimum requirements for industry standards. For example, when used in a recloser application, the vacuum interrupter should meet industry standards outlined in for example ANSI/IEEE C37.60 for reclosers.

The vacuum interrupter 12 is supported by a dielectric housing 32 preferably made of a glass filled polyester. The housing 32 is a unitary one-piece member that is hollow and generally cylindrical in shape to accommodate the vacuum interrupter 12. A first end 34 of the housing 32 includes an opening 36 for receiving a conductive insert or first terminal 38 molded into the opening 36 of the housing 32. A bolt 40 extends through the insert 38 into the vacuum interrupter stationary contact 26 thereby connecting the insert 38 to the vacuum interrupter 12. The insert 38 provides a mechanism for electrically connecting the stationary contact 26 and the vacuum interrupter 12 directly or indirectly to a power distribution system.

Between the vacuum bottle 18 and the dielectric housing 32 is a dielectric filler 42 that fills the space therebetween, thereby replacing the lower dielectric strength air with a higher dielectric material. In particular, the filler 42 is a dielectric material that bonds to all contact surfaces ensuring an arc track resistant surface interface. The filler can be any dielectric material such as a dielectric epoxy, polyurethane, a silicone grease or solid. Preferably, the filler 42 is room temperature curable and has an acceptable pot life to allow ease in manufacturing. The filler preferably has a very low viscosity to enable the manufacturing and assembly process to be done without using a vacuum.

Weathershed insulation 44 is disposed around the outside of the dielectric housing 32 to provide dielectric strength and weatherability to the vacuum interrupter 12. Preferably, the weathershed insulation 44 is made of a rubber material, such as rubber, EPDM, silicone or any other known material. Alternatively, the weathershed 44 and the dielectric housing 32 can be formed as a unitary housing made of a dielectric epoxy material.

A flexible shunt 46 is rigidly attached to the movable contact 28 using a stud bolt 48. Preferably, the shunt 46 is made of sheets of thin copper material. The flexible shunt 46 is connected to a current ring 50 to allow current to transfer from the movable contact 28 to the current ring 50. Preferably, the flexible shunt 46 has two connections to the current ring 50 so that any current traveling through the shunt is split between the connections. This allows less copper to be used and maintains a balanced mechanical load on the moving contact and drive parts.

The solenoid assembly 14 is a latching or bistable mechanism that moves the movable contact 28 between and holds it in the open and closed positions with respect to the stationary contact 26. The solenoid assembly 14 includes a generally cylindrical housing 52 with a first end 54 and a second, opposing end 56. A spring guide 58 is connected to the first end 54 of the solenoid assembly 14. Preferably, the connection is made with three 10-32 screws 60. The solenoid assembly 14 has a longitudinal plunger 62 received therein. The plunger 62 has a first connection end 64 for connecting to the turnbuckle and weld break assembly 16 and a second, opposing end 66 without any insulation therebetween. Also received within the cylindrical housing 52 is an actuator block 68 that is generally cylindrical. The end 66 of the plunger 62 extends through an opening 70 in the actuator block 68 into an inner bore 72 in the actuator block 68. A preload adjustment screw 76 extends through an actuator cover 78 and into the inner bore 72 of the actuator block 68. A biasing member 80 is disposed in the inner bore 72 between the end 66 of the plunger 62 and the end 74 of the preload adjustment screw 76. The biasing member 80 is preferably a plurality of Belleville washers. The preload adjustment screw 76 is threadably connected to the actuator cover 78 so that the load applied by the biasing member 80 on the plunger 62 can be increased or decreased by adjusting the screw 76. This allows selection of the appropriate amount of load to ensure the proper connection between the stationary contact 26 and the movable contact 28 in the vacuum interrupter 12. Preferably, the preload adjustment screw 76 is turned so that the biasing member applies a force of 130 lbs. This ensures that the holding force is at least 130 lbs the instant the contacts touch when they are closing.

Figure 3:
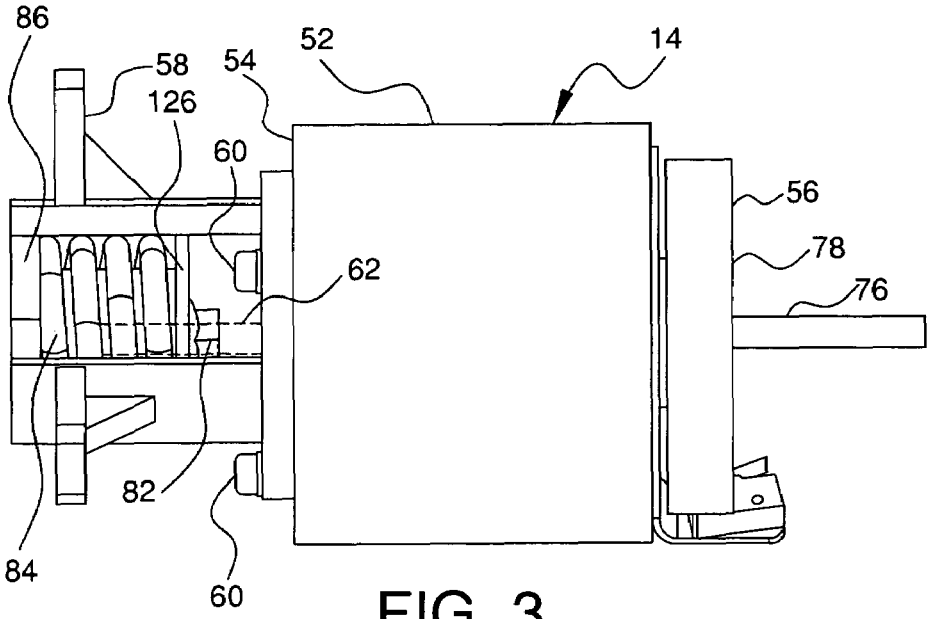
FIG. 3 is an enlarged side elevational view of the solenoid assembly of the circuit interrupting device illustrated in FIG. 1.

An adjustment nut 82 is threaded onto the connection end 64 of the plunger 62 so that a drive disk 126 may be slid onto the plunger 62 and placed adjacent to the nut 82 (FIG. 3). A biasing member 84, preferably a coil spring, is located between the drive disk 126 and a radial spring seat 86 of the spring guide 58. In this manner, the force generated by the biasing member 84 is applied to the plunger 62.

A permanent magnet 88, preferably any rare earth magnet, abuts the first end 90 of the actuating block 68, and holds the actuating block 68 toward the magnet 88, forcing the movable contact 28 against the stationary contact 26 in the vacuum interrupter 12 closed position. The permanent magnet 88 and flux concentrator 92 allow the solenoid assembly 14 to hold the vacuum interrupter contacts 26, 28 closed without power. An energy coil 94 surrounds the actuator block 68. The coil 94 creates an opposing magnetic force, opposite to the magnet, releasing the actuator block 68 away from the magnet 88 when energized in a first direction. In this manner, the biasing member 84 forces the actuator block 68 away from the magnet 88, thereby moving the movable contact 28 away from the stationary contact 26 to the open position. The coil 94 can also create a magnetic force in the same direction as the magnet 88. This overcomes the force of the biasing member 84 and moves the movable contact 28 back into the closed position.

The biasing member 84 also controls the vacuum interrupter contact bounce when the vacuum interrupter is closed. The biasing member 84 applies pressure to the plunger 62, rather than applying pressure directly to the actuator block 68. This arrangement allows pressure to be maintained on the plunger 62 throughout the closing stroke. The spring also assists in the prevention of contact bounce by opposing the forces generated by the biasing member 80 located in the actuator block 68. This arrangement allows a higher preload on the biasing member 80. The forces generated by the biasing member 80 oppose any recoil of the movable contact 28 at the moment the movable impacts the stationary contact 26 during a close operation.

The stud bolt 48 in the movable contact 28 is connected to the plunger 62 of the solenoid assembly 14 by a turnbuckle and weld break assembly 16. As seen most clearly in FIGS. 5 and 6, the turnbuckle and weld break assembly 16 has an outer slide body 96 attached to the stud bolt 48 by a first set of threads 98. The pitch of the first set of threads is preferably 18 threads per inch. An inner slide member 100 is slidably received within the outer slide body 96 and is attached to the plunger 62 by a second set of threads 102. The pitch of the second set of threads is different than the pitch of the first set of threads and is preferably 24 threads per inch. The first and second set of threads preferably face the same direction (e.g. both are right-handed threads), but may face opposite directions. A groove pin 104 extends through a hole 106 in the inner slide member 100 and rests in slots 108 located in the outer slide body 96. This allows the outer and inner slide members 96, 100 to slide relative to one another for a predetermined length that is the length of the slots 108, which length is greater than the transverse diameter of the groove pin 104. A washer 110 encircles the outer slide body 96 and abuts the groove pin 104. A coil spring 112 is located between the washer 110 and a shoulder 114 on the outer slide body 96 and biases the groove pin 104 toward one end 116 of the slot 108. In operation, if the stationary contact 26 is welded to the movable contact 28, the plunger 62 may begin moving the length of the slot 108. When the groove pin 102 reaches the second end 118 of the slot 108, it creates a hammer force on the movable contact 28, breaking any welds between the contacts 26, 28. Further, when the plunger reaches the end of its travel, the spring 112, which was compressed at the start of the travel of the actuator, biases the groove pin 104 back toward its original position at the first end 116 of the slot 108. The movable contact 28 therefore moves the same distance as the plunger 62. Without the spring 112, the movable contact 28 would move the length of the travel of the plunger 62 minus the length of the slot 108. The compression force of the spring 112 should be greater than the inherent contact force of the vacuum interrupter 12 when the vacuum interrupter is fully open (e.g. about 9 mm).

Assembly of the Circuit Interrupting Device

Figure 4:
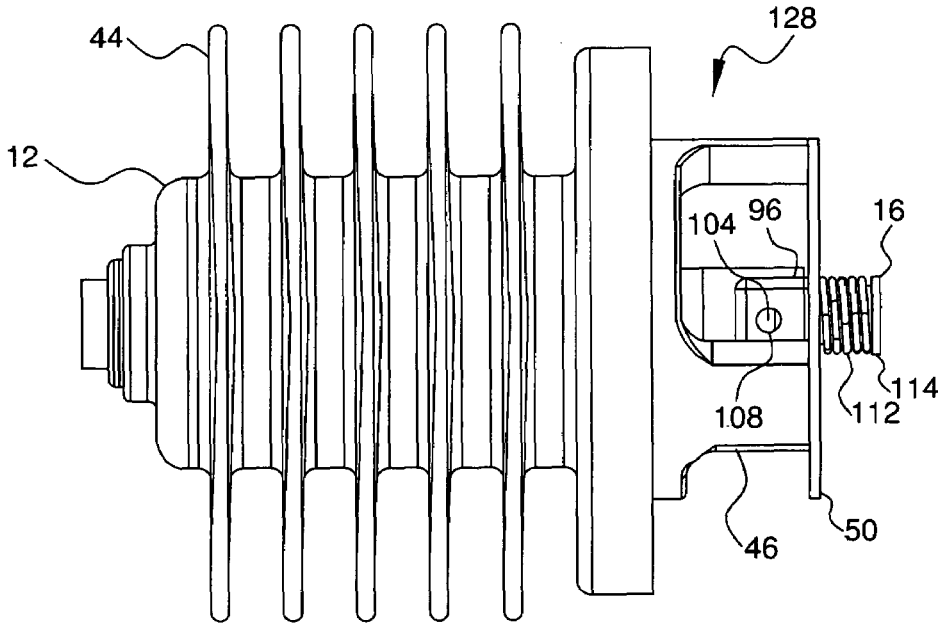
FIG. 4 is an enlarged side elevational view of the vacuum interrupter and shunt assembly of the circuit interrupting device illustrated in FIG. 1.
Figure 5:
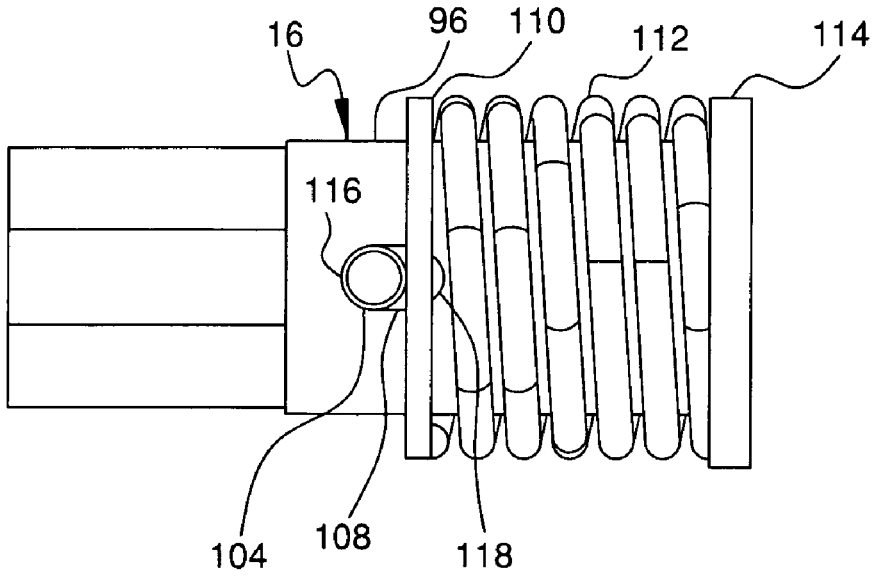
FIG. 5 is an enlarged side elevational view of the turnbuckle and weld break assembly of the circuit interrupting device illustrated in FIG. 1.
Figure 6:
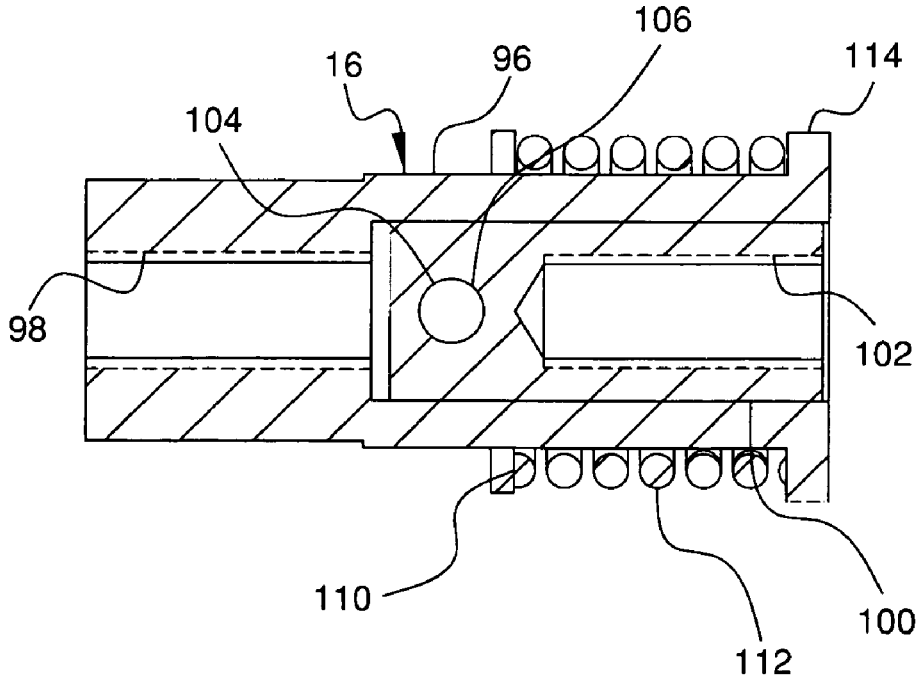
FIG. 6 is a side elevational view in section of the turnbuckle and weld break assembly illustrated in FIG. 5.
Figure 7:
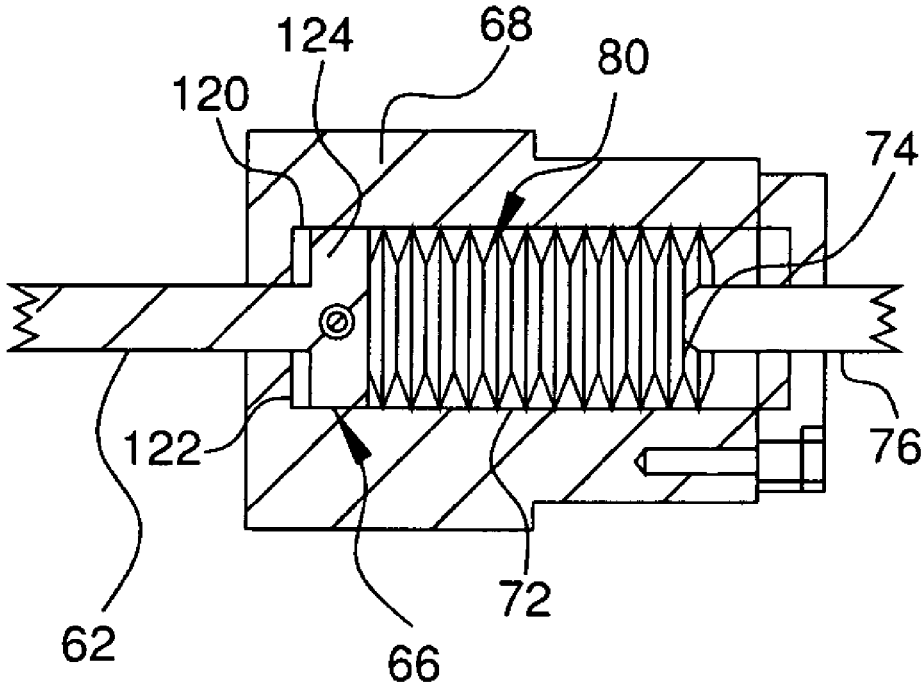
FIG. 7 is an enlarged side elevational view in section of the actuator block and plunger of the solenoid assembly illustrated in FIG. 3.

Referring to FIGS. 3 and 4, the circuit interrupting device 10 is preferably assembled by building the solenoid assembly 14, building a vacuum interrupter and shunt assembly 128, and then connecting the two assemblies together. To build the solenoid assembly 14, the preload adjustment screw 76 is threaded into the actuator cover 78. The screw 76 is turned to apply six turns of pressure on the biasing members 80. Preferably, six turns on the screw 76 apply around 130 lbs. of preload pressure. Next, the adjustment nut 82 is threaded onto the connection end 64 of the plunger 62. The biasing member 84 and drive disk 126 are then slid onto the plunger 62. The spring guide 58 is attached to the solenoid housing 52. The spring guide 58 is attached using a holding fixture such as a vice because the biasing member 84 is under pressure when assembled. The adjustment nut 82 is adjusted to apply an appropriate preload force on the biasing member 84. Preferably, the compressed length of the biasing member 84 is 1⅛ inches.

To build the vacuum interrupter and shunt assembly 128, the flexible shunt 46 is fastened to the current ring 50. The flexible shunt 46 is then attached to the vacuum interrupter by threading the stud bolt 48 into the moving contact 28 of the vacuum interrupter 12. Preferably, a flat washer and a serrated Belleville washer (not illustrated here) are placed between the bolt 48 and the shunt 56 to prevent loosening of the connection between the bolt 48 and the moving contact 28. The turnbuckle and weld break assembly 16 is threaded as far as it will go onto the stud bolt 48.

The solenoid assembly 14 is then attached to the vacuum interrupter and shunt assembly 128 by threading the plunger 62 of the solenoid assembly 14 into the turnbuckle and weld break assembly 16. The plunger 62 is threaded into the turnbuckle and weld break assembly 16 until there is no gap between the spring guide 58 and the current ring 50. At this point, continuing to thread the plunger 62 into the turnbuckle assembly 16 will begin to separate the vacuum interrupter contacts 26, 28. The threading operation should be stopped just before the contacts separate. Three 10-32 screws 130 are used to attach the spring guide 58 and the current ring 50 to the dielectric housing 32.

Setup of the Circuit Interrupting Device

Before the circuit interrupter device 10 will function properly, the turnbuckle and weld break assembly 16, the adjustment nut 82, and the preload adjustment screw 76 must all be adjusted. Starting with the turnbuckle and weld break assembly 16, due to the different pitches of the first and second set of threads 98, 102, when the turnbuckle is turned counter clockwise it has the effect of pushing the plunger 62 backwards against the biasing member 80. As seen most clearly in FIG. 7, this creates a gap 120 between the plunger 62 and the bottom 122 of the inner bore 72 of the actuator block 68. The gap 102 is the contact wipe distance, and it allows the contacts 26, 28 of the vacuum interrupter 12 to erode without losing the contact pressure generated by the biasing member 80 in the solenoid assembly 14. The turnbuckle is turned counter-clockwise 3 full turns, which preferably creates a wipe distance of approximately 1 mm. The gap 120 is lost motion—i.e. the gap requires that the actuator block 68 move 10 mm from closed to open to obtain a 9 mm gap between the contacts 26, 28 of the vacuum interrupter 12.

The adjustment nut 82 is adjusted for more or less compression on the biasing member 84 as needed. The adjustment nut 82 is adjusted properly when the actuator block 68 moves the full distance (preferably 10 mm) when actuated and also maintains a small preload when the contacts are fully open. In other words, the adjustment nut 82 is adjusted so that the actuator block 68 cannot be pushed and stopped at some point in the stroke less then fully open or fully closed.

The preload adjustment screw 76 is adjusted by increasing the pressure applied to the biasing member 80 until the unit just barely opens when 52 volts is applied to the coil 94 from a 1000 uF capacitor. If the unit opens below this value, the preload adjustment screw is adjusted to apply less pressure. Further, the unit should close and latch with 50 volts applied by a 1000 uF capacitor. If too much pressure is applied by the preload adjustment screw 76, the actuator block 68 will close but will not latch. If this occurs, the pressure can be decreased by turning the set screw back by ½ a turn counter-clockwise or any other suitable amount.

After performing these adjustments, the unit should be checked for bounce free closure by using an oscilloscope.

While one embodiment has been chosen to illustrate the invention, it will be understood by those skilled in the art that various changes and modifications can be made therein without departing from the scope of the invention as defined in the appended claims.

What is claimed is:

1. A circuit interrupting device for use with an electrical circuit, comprising: a circuit interrupter including a primary contact and a moveable contact movable relative to said primary contact between a closed position allowing current to pass through said circuit interrupter and an open position separating said contacts and preventing current from passing through said circuit interrupter; a solenoid assembly with a plunger; and a turnbuckle assembly connected to said plunger of said solenoid assembly by a first set of threads and connected to said movable contact by a second set of threads.

2. A circuit interrupting device according to claim 1, wherein said first and second set of threads have a different pitch.

3. A circuit interrupting device according to claim 1, wherein said first and second set of threads face opposite directions.

4. A circuit interrupting device according to claim 1, wherein said turnbuckle assembly comprises: an outer slide threadably attached to said movable contact by said second set of threads; and an inner slide threadably attached to said plunger of said solenoid by said first set of threads, said inner slide being slidably connected to said outer slide so that said inner slide may slide a predetermined distance relative to said outer slide.

5. A circuit interrupting device according to claim 4, wherein a groove pin extends radially from said inner slide and is slidably located in at least one slot in said outer slide to control relative movement between said inner slide and said outer slide.

6. A circuit interrupting device according to claim 5, wherein a spring biases said groove pin toward one end of said at least one slot.

7. A circuit interrupting device according to claim 5, wherein said actuator block and said plunger are connected by at least one second biasing member.

8. A circuit interrupting device according to claim 7, wherein said at least one second biasing member is a Belleville washer.

9. A circuit interrupting device according to claim 8, further comprising: an adjustment screw threadably attached to said solenoid assembly to adjust a preload amount on said Belleville washer.

10. A circuit interrupting device according to claim 5, wherein said groove pin engages said at least one slot in said outer slide to generate an impact force to break a weld between said primary contact and said moveable contact.

11. A circuit interrupting device according to claim 1, wherein said solenoid assembly comprises: an actuator block connected to said plunger; a permanent magnet located adjacent to said actuator block and producing a magnetic force attracting said actuator block towards said permanent magnet; a coil located adjacent to said actuator block and generating a magnetic force when current is passed therethrough; and a first biasing member biasing said plunger towards said open position.

12. A circuit interrupting device according to claim 11, wherein said first biasing member is a coil spring.

13. A circuit interrupting device according to claim 12, further comprising: means for adjusting the force of said coil spring.

14. A circuit interrupting device according to claim 12, wherein a nut is threadably attached to the plunger to adjusting the force of said coil spring.

15. A circuit interrupting device for use with an electrical circuit, comprising: a circuit interrupter including a primary contact and a moveable contact movable relative to said primary contact between a closed position allowing current to pass through said circuit interrupter and an open position separating said contacts and preventing current from passing through said circuit interrupter; a solenoid assembly with a plunger; an outer slide attached to said movable contact and having at least one slot, said slot being axially elongated; an inner slide attached to said plunger of said solenoid and being slidably connected to said outer slide; a groove pin extending radially from said inner slide and located in said at least one slot in said outer slide; and a spring biasing said groove pin toward one end of said at least one slot.

16. A circuit interrupting device according to claim 15, wherein said outer slide is attached to said movable contact by a first set of threads having a first pitch; and said inner slide is attached to said plunger by a second set of threads having a second pitch.

17. A circuit interrupting device according to claim 15, wherein said first pitch and said second pitch are different.

18. A circuit interrupting device according to claim 15, wherein said first and second set of threads face opposite directions.

19. A circuit interrupting device according to claim 15, wherein said solenoid assembly comprises: an actuator block connected to said plunger; a permanent magnet attached to said actuator block and generating a magnetic force attracting said actuator block towards said permanent magnet; a coil located adjacent said actuator block and generating a magnetic force when current is passed therethrough; and a first biasing member biasing said plunger towards said open position.

20. A circuit interrupting device according to claim 19, wherein said first biasing member is a coil spring.

21. A circuit interrupting device according to claim 20, further comprising: means for adjusting the force of said coil spring.

22. A circuit interrupting device according to claim 20, wherein a nut is threadably attached to the plunger to adjust the force of said coil spring.

23. A circuit interrupting device according to claim 19, wherein said actuator block and said plunger are connected by at least one second biasing member.

24. A circuit interrupting device according to claim 23, wherein said at least one second biasing member is a Belleville washer.

25. A circuit interrupting device according to claim 24, further comprising: an adjustment screw threadably attached to said solenoid assembly to adjust a preload amount on said Belleville washer.

26. A circuit interrupting device according to claim 15, wherein said groove pin engages said at least one slot in said outer slide to generate an impact force to break a weld between said primary contact and said movable contact.

27. A circuit interrupting device for use with an electrical circuit, comprising:

a circuit interrupter including a primary contact and a movable contact movable relative to said primary contact between a closed position allowing current to pass through said circuit interrupter and an open position separating said contacts and preventing current from passing through said circuit interrupter;

a solenoid assembly with a plunger; and a turnbuckle assembly with a first end attached to the movable contact of said circuit interrupter and a second end attached to the plunger of said solenoid, said turnbuckle assembly generating sufficient impact force to break a weld between said primary contact and said movable contact.

28. A circuit interrupting device according to claim 27, wherein said first end of said turnbuckle assembly is threadably attached to said movable contact by a first set of threads; and said second end of said turnbuckle assembly is threadably attached to said plunger of said solenoid by a second set of threads.

29. A circuit interrupting device according to claim 28, wherein the pitch of said first and said second set of threads are different.

30. A circuit interrupting device according to claim 28, wherein said first and second set of threads face opposite directions.

31. A circuit interrupting device according to claim 27, wherein said solenoid assembly comprises: an actuator block connected to said plunger; a permanent magnet located adjacent said actuator block and generating a magnetic force attracting said actuator block towards said permanent magnet; a coil located adjacent said actuator block and generating a magnetic force when current is passed therethrough; and a first biasing member biasing said plunger towards said open position.

32. A circuit interrupting device according to claim 31, wherein said first biasing member is a coil spring.

33. A circuit interrupting device according to claim 32, further comprising: means for adjusting the force of said coil spring.

34. A circuit interrupting device according to claim 32, wherein a nut is threadably attached to the plunger to adjust the force of said coil spring.

35. A circuit interrupting device according to claim 31, wherein said actuator block and said plunger are connected by at least one second biasing member.

36. A circuit interrupting device according to claim 35, wherein said at least one second biasing member is a Belleville washer.

37. A circuit interrupting device according to claim 36 further comprising: an adjustment screw threadably attached to said solenoid assembly to adjust a preload amount on said Belleville washer.

38. A circuit interrupting device according to claim 27, wherein said turnbuckle assembly comprises:

an outer slide attached to said movable contact; and an inner slide attached to said plunger of said solenoid and slidably connected to said outer slide for relative movement therebetween along a predetermined length.

39. A circuit interrupting device according to claim 38, wherein said outer slide is a tubular member receiving said inner slide therein, with said inner and outer slides, said plunger, and said movable contact being substantially coaxial.

* * * * *